United States Patent [19]

Chibana et al.

[11] 4,108,040

[45] Aug. 22, 1978

[54] ELECTRONIC MUSICAL INSTRUMENT

[75] Inventors: Masanobu Chibana; Tsuyoshi Futamase; Hideo Yamada, all of Hamamatsu, Japan

[73] Assignee: Nippon Gakki Seizo Kabushiki Kaisha, Hamamatsu, Japan

[21] Appl. No.: 742,586

[22] Filed: Nov. 17, 1976

[30] Foreign Application Priority Data

Nov. 19, 1975 [JP] Japan ..... 50-139005

[51] Int. Cl.[2] ..... G10H 1/02

[52] U.S. Cl. ..... 84/1.19; 84/1.21; 84/1.11

[58] Field of Search ..... 84/1.01, 1.03, 1.11, 84/1.19, 1.24, 1.21

[56] References Cited

U.S. PATENT DOCUMENTS

| | | | |
|---|---|---|---|
| 3,809,786 | 5/1974 | Deutsch | 84/1.01 |
| 3,956,960 | 5/1976 | Deutsch | 84/1.19 |
| 4,000,675 | 1/1977 | Futamase et al. | 84/1.01 |
| 4,026,179 | 5/1977 | Futamase | 84/1.01 X |

*Primary Examiner*—Ulysses Weldon

*Attorney, Agent, or Firm*—Spensley, Horn & Lubitz

[57] ABSTRACT

An electronic musical instrument wherein instantaneous amplitude values of respective harmonics of a musical tone waveform are individually provided in accordance with a numerical value corresponding to the frequency of the depressed key for the musical tone, each of harmonic amplitude coefficients setting relative amplitudes of the respective harmonics is multiplied with corresponding one of the instantaneous amplitude values and the multiplication products are aligned with respect to time thereby to obtain a musical tone of a desired tone color, i.e. of a desired frequency spectrum construction. The harmonic amplitude coefficients are given as values corresponding to a multipeak spectrum construction.

The harmonic amplitude coefficients are provided by a filter having a multipeak characteristic. This filter produces harmonic amplitude coefficients which change in accordance with the order of the harmonics and/or time and has a multipeak filter characteristic such that the origin of the frequency is shifted with lapse of time or the bandwidth of a single peak changes in accordance with the order of the harmonics or lapse of time.

6 Claims, 13 Drawing Figures

ELECTRONIC MUSICAL INSTRUMENT

BACKGROUND OF THE INVENTION

This invention relates to an electronic musical instrument and, more particularly, to a digital electronic musical instrument having a multipeak filter characteristic.

The frequency spectrum of the sound produced by natural musical instruments such as violins, cellos and oboes includes a number of resonance peaks and the amplitudes of respective harmonic components are varied in an extremely complicated manner under vibrato performance so that the construction of the spectrum varies with time in an extremely complicated manner. Such complicated variation with time of the spectrum construction including many resonance peaks characterizes the tone of the natural musical instruments. Such spectrum having many resonance peaks can be realized by using a filter having multipeak characteristic (comb shaped filter). A prior art multipeak filter comprises an analogue circuit wherein a plurality of resonance circuits having different resonance frequencies are connected in parallel and an analogue tone source signal is applied to the parallel circuits. It is difficult in such multipeak analogue filter to vary its characteristic with lapse of time, once the characteristic has been set. Even if the characteristics is not required to be varied with time, but merely required to be changed to another characteristic, it is necessary to vary constants of various resonance circuit elements, for instance capacitors or inductance coils; which is extremely troublesome. For this reason, it has been extremely difficult to vary the multipeak spectrum construction with time for simulating tones of a natural musical instrument.

SUMMARY OF THE INVENTION

Accordingly, it is an object of this invention to provide an improved electronic musical instrument capable of producing a time-variant multipeak spectrum construction by constructing a multipeak filter (or filter function) with a digital circuit thereby simulating the musical tone of a natural musical instrument whose multipeak spectrum construction varies with time.

According to this invention, there is provided an electronic musical instrument of a type wherein the amplitudes of respective harmonic components constituting a musical sound are set independently by amplitude coefficients corresponding to respective harmonics, there is provided means for cumulatively adding numerical values in accordance with the order of respective harmonics thereby obtaining the amplitude coefficients of respective harmonics of a desired multipeak filter characteristic.

The invention is applicable to such electronic musical instrument as disclosed in the specification of U.S. Pat. No. 3,809,786 wherein the instantaneous amplitude values (i.e. amplitude samples) of the waveforms of respective harmonics are provided (by calculation or reading memory) independently in accordance with numerical values corresponding to the frequencies of the depressed keys, the resulting amplitude values are multiplied respectively by corresponding harmonic amplitude coefficients utilized to independently set the relative amplitudes of respective harmonic components and the multiplication products are aligned with respect to time thereby producing a desired tone color, i.e. a musical tone having a desired frequency spectrum construction. According to the present invention the harmonic amplitude coefficients are given in the form of values corresponding to the multipeak spectrum thereby substantially realizing a filter function of a multipeak characteristic. Moreover, values of the harmonic amplitude coefficients are varied with time thereby enabling the multipeak characteristic to vary with time.

According to this invention, the filter has a multipeak characteristic which is given by a mathematical function $f(X)$ where the variable X is related to the order of the harmonic. The value $f(X_n)$ of the function $f(X)$ for the value $X_n$ of the variable X given for calculation of a harmonic of the $n$-th order corresponds to the amplitude coefficient of the $n$-th harmonic. The function $f(X)$ realizing the multipeak filter characteristic can be afforded by a suitable function memory circuit or a computing circuit. According to this invention, the value $X_n$ of the variable X corresponding to the $n$-th order is given in the form of a function of time. Accordingly, even for the same order $n$, the value $X_n$ varies as time elapses so that the value of the amplitude coefficient $f(X_n)$ of the $n$-th harmonic also varies with time. This means that the multipeak characteristic is caused to vary with time. Furthermore, according to this invention, the value $X_n = X_i$ corresponding to the $i$-th order is determined by cumulatively adding the informations $H_n (n = 1, 2 \ldots i, \ldots)$ for setting positions of respective harmonics of the filter according to the following equation:

$$X_i = \sum_{n=1}^{i} H_n \tag{1}$$

In other words, the value obtained by cumulatively adding the information regarding the harmonics of the $i$-th and lower orders is utilized as $X_i (= X_n)$. The variation with time of the multipeak characteristic is realized by giving the information $H_n$ in terms of a function of time (that is $X_n$ becomes a function of time)

BRIEF DESCRIPTION OF THE DRAWINGS

The invention can be more fully understood from the following detailed description taken in conjunction with the accompanying drawings in which.

DESCRIPTION OF THE PREFERRED EMBODIMENTS

Figure 1:
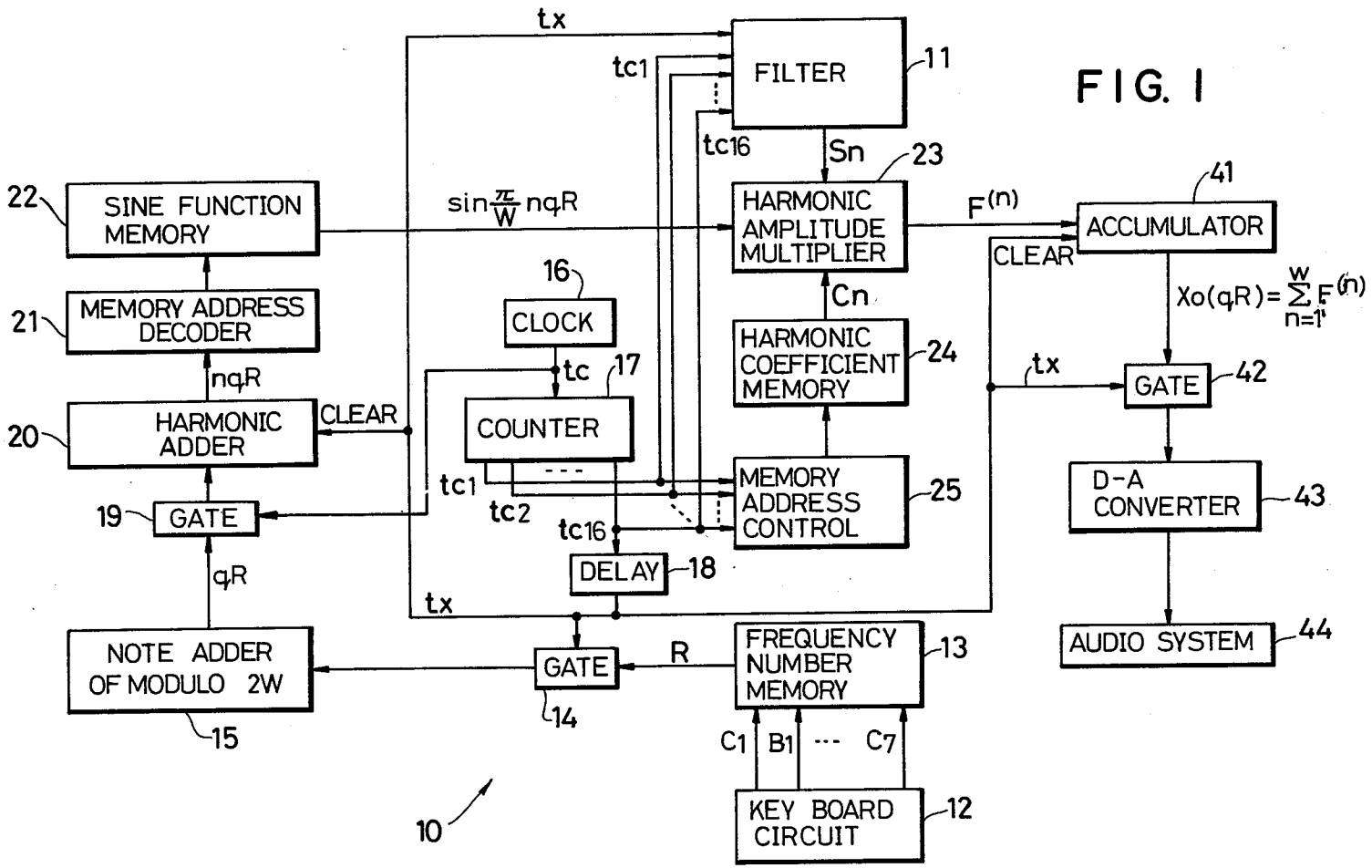
FIG. 1 is a block diagram illustrating a preferred embodiment of this invention.

Majority of the component elements of an electronic musical instrument 10 shown in FIG. 1 are identical to those disclosed in the specification of U.S. Pat. No. 3,809,786. The only element added by this invention is a filter 11. Accordingly, the construction of the electronic musical instrument 10 per se will not be described in detail but only the filter 11 will be described in detail.

In the electronic musical instrument 10, a frequency number memory 13 is used to store frequency numbers R proportional to the fundamental frequencies of respective keys. The frequency number R corresponding to a depressed key is read out of the frequency number memory 13 by a signal representing the depressed key and produced by a keyboard circuit 12. The read out frequency number R is supplied to a note adder 15 of a modulo 2W via a gate circuit 14 opened by the timing action of a pulse *tx* to be added to the contents already stored in the adder 15. Accordingly, the content of the note adder 15 defines a value *q*R representing a reading address of the waveform, where *q* represents a number increasing as 1, 2, 3 . . . at each interval of calculation time *tx* which is set by the pulse *tx*.

The timing of the operation of the electronic musical instrument 10 is set by a clock pulse generator 16 and a scale-of-W counter 17. The number W represents the number of harmonics utilized to synthesize a musical tone by the electronic musical instrument 10, and is 16, for example. The waveform amplitude value at the designated address is calculated during the calculation interval *tx* during which the clock pulse generator 16 generates 16 (or W) clock pulses *tc*. In response to these clock pulses *tc*, the counter 17 produces sequentially a series of timing pulses $t_{c1}$ through $t_{c16}(T_{cw})$. The interval of the clock pulse determines the calculating time of each harmonic component and the 16 pulses $t_{c1}$ through $t_{c16}$ which are generated in an interval $t_x$ correspond to the calculation times of the first fundamental wave) to the 16th harmonic components, respectively. The last pulse $t_{c16}$ is delayed slightly by a delay circuit 18 for producing pulse $t_x$.

The clock pulse $t_c$ enables a gate circuit 19 to supply the contents of the note adder 15 to a harmonic adder 20 which cumulatively adds the *q*R at a timing of the clock pulse $t_c$ to produce contents of *nq*R, where $n = 1, 2, 3 . . . w(16)$. An address decoder 21 is provided to deliver an individual address designation output in response to an inputed *ng*R in coded representation, thereby preparing for reading sin $\pi$/W *nq*R corresponding to the output *nq*R of the adder 20 from a sine function memory device 22. The sine function value sin $\pi$/W *nq*R is equal to sin $\pi$/W *q*R at the calculation time $t_{c1}$ of the fundamental frequency, equal to sin $\pi$/W 2*q*R at the calculation time $t_{c2}$ of the second harmonic and equal to sin $\pi$/W 16*q*R at the calculation time $t_{c16}$ of the 16th harmonic. But the value *q*R does not vary during an interval from $t_{c1}$ to $t_{c16}$.

The value of the sine function read out of the memory device 22 is supplied to a harmonic amplitude multiplier 23 to be multiplied with a first harmonic coefficient Cn supplied from a harmonic coefficient memory device 24 and/or with a second harmonic coefficient Sn corresponding to the multipeak characteristic and supplied from the filter 11. This memory device 24 is storing the amplitude coefficients $C_n (n = 1, 2 . . . 16)$ of respective harmonics corresponding to the spectrum construction required to produce a desired constantly sustaining tone not varying with time and its reading is controlled by a memory address control circuit 25. To the memory address control circuit 25 are applied pulses $t_{c1}$ - $t_{c16}$ corresponding to the calculation times of respective harmonics for applying a harmonic coefficient C*n* corresponding to the order *n* of the value of the sine function sin $\pi$/W *nq*R to a multiplier 23.

Figure 2:
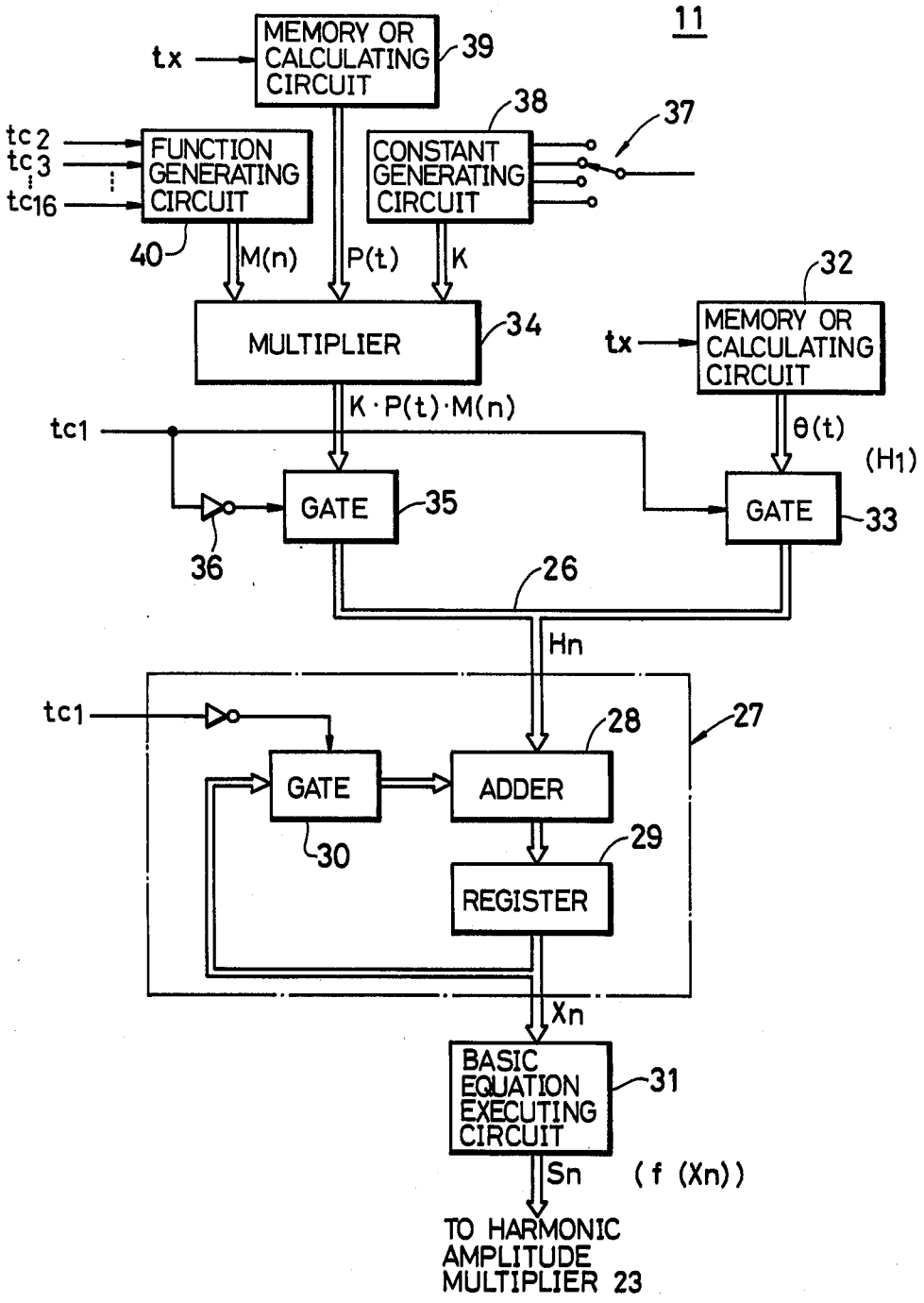
FIG. 2 is a block diagram showing one example of the filter comprising an essential element of the embodiment shown in FIG. 1.

The harmonic coefficient Sn produced by the filter 11 corresponds to the value $f(X_n)$ of the *n*-th harmonic of the function $f(X)$ expressing the multipeak characteristic. One example of the construction of the filter 11 is shown in FIG. 2. The information Hn expressed by equation (1) utilized to set or change the positions of respective harmonics on the multipeak characteristic is applied to an accumulator 27 through a line 26. The accumulator 27 is constituted by an adder 28, a register 29 and a gate circuit 30, and is of a modulo 64 type, for example. The information Hn is applied sequentially for each harmonic with the timing of $t_{c1}$ - $t_{c16}$ so that the accumulator 27 produces the value $X_n$ by cumulatively adding H*n*.

Figure 3A:
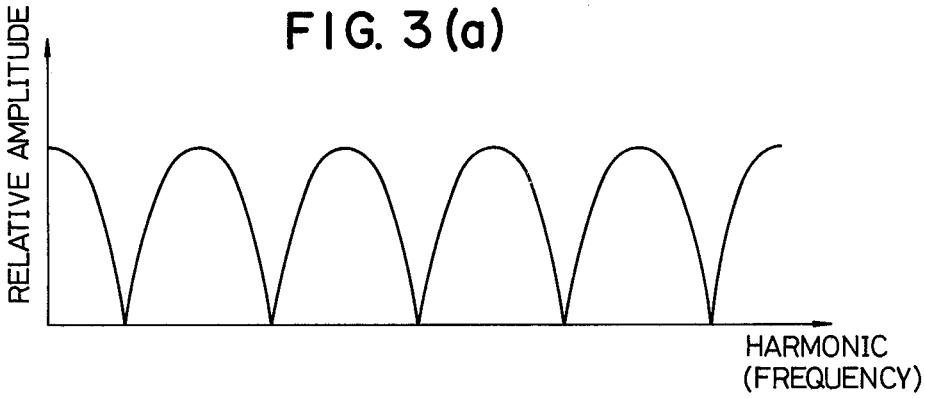
FIG. 3*a* is a graph showing one example of a fundamental multipeak filter characteristic.
Figure 3B:
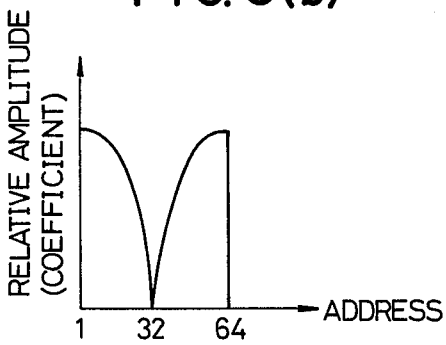
FIG. 3*b* is a graph showing a single peak filter characteristic formed by a circuit executing a basic equation.

A circuit 31 for executing the basic equation of the multipeak characteristic is connected to receive the value $X_n$ as the variable X of the basic equation $f(X)$ of the multipeak filter characteristic so as to execute or realize the equation $f(X)$ thus obtaining the amplitude coefficient $f(X_n) = S_n$ of the *n*-th harmonic corresponding to the filter characteristic. The circuit 31 may use a suitable read-only memory or an operation circuit. Any type of the basic equation $f(X)$ is established in accordance with a desired multipeak filter characteristic. For example, where the multipeak filter characteristic to be obtained has a form as shown in FIG. 3*a*, only a single peak filter characteristic as shown in FIG. 3*b* is stored in the circuit 31. Since the accumulator 27 is of a modulo 64 type, the circuit 31 is provided with 64 memory addresses. Thus, the multipeak characteristic can be obtained by repetition of a single peak characteristic so that it is not necessary to specify absolute positions of respective harmonics (frequencies) of the filter characteristic, but it is only necessary to specify which phases in the repeated single peak characteristic the positions of the harmonics correspond to.

Figure 3C:
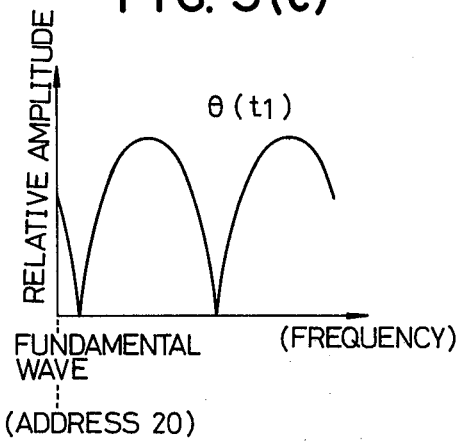
FIGS. 3*c* and 3*d* are graphs showing shift of the position of the origin of the frequency in a multipeak filter characteristic.
Figure 3D:
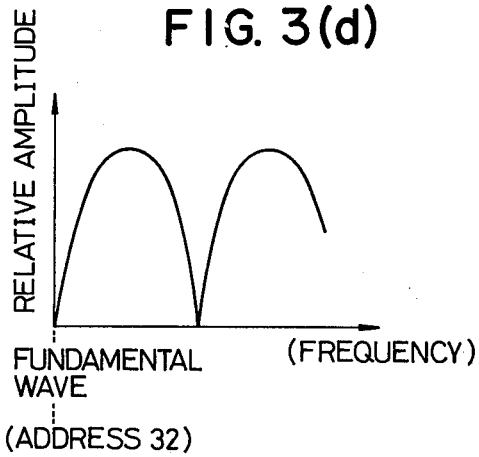

In the information $H_n$ for setting the positions of respective harmonics of the multipeak characteristic, the information $H_1$ regarding the fundamental wave is generated by a memory circuit or the operation circuit 32. This circuit is constructed such that the function $H_1$ is given by a function of time $\theta(t)$. The operation circuit 32 receives the calculation time pulse $t_x$ as the time element to read out the value of o$\theta(t)$ from the memory circuit or calculate the value of $\theta(t)$ in accordance with the calculation time pulse $t_x$. Accordingly, it is possible to vary the information $H_1(\theta(t))$ regarding the fundamental wave as a function of time. A gate circuit 33 is enabled by a calculation timing pulse $t_{c1}$ for the fundamental wave so as to supply the information $H_1$ given by the function $\theta(t)$ to the accumulator 27 via line 26. Since the gate circuit 30 is closed by pulse $t_{c1}$, only the information $H_1 = \theta(t)$ is applied to the adder 28 so that the adder 28 applies the information $H_1 = \theta(t)$ to the circuit 31 via register 29 as the variable input $X_n$. Since the fundamental wave corresponds to the origin of the frequency of the filter that realizes the spectrum construction, the amplitude coefficient $S_n = S_1$ read out from the circuit 31 in accordance with the information $H_1$ represents the relative amplitude at the origin of the filter characteristic. Consequently, when the value of the information $H_1$ is caused to vary with time by the function $\theta(t)$, the origin of the frequency of the resulting filter characteristic also varies with time. Assuming now that the function $\theta(t_1)$ at a time $t_1$ has a value of 20, the data $f(X_n)$ of the address 20 is read out of the circuit 31 by the information $H_1 = X_n = 20$. This data corresponds to the harmonic amplitude coefficient $S_1$ regarding the fundamental wave thereby setting the frequency origin of the filter as shown in FIG. 3c. Further, when the value of the function $\theta(t_2)$ at time $t_2$ is 32, the data $f(X_n)$ of address 32 is read out of the circuit 31 thus shifting the frequency origin of the filter as shown in FIG. 3d.

Among the information $H_n$, information $H_2$ - $H_{16}$ of the second to 16th harmonics other than the fundamental wave are applied to the accumulator 27 via the gate circuit 35. After being inverted by an inverter 36 the pulse $t_{c1}$ is applied to a gate circuit 35 so that this gate circuit is disenabled during the pulse $t_{c1}$ but enabled during the pulses $t_{c2}$ - $T_{c16}$. The information $H_n$(where $n = 2, 3 \ldots 16$) is produced by multiplying with each other a constant $k$ which sets the basic filter characteristic, a function $P(t)$ which sets the variation with time of the filter characteristic, and a function $M(n)$ of the order $n$ of the harmonics that modifies the basic filter characteristic in a frequency region.

Thus $$H_n = K \cdot P(t) \cdot M(n) \tag{2}$$

where $n = 2, 3, \ldots 16$(W)

A constant K of a value corresponding to the set position of a constant selection switch 37 is produced by a constant generating circuit 38 which may be constituted by a suitable memory, encoder or a decoder. The time function $P(t)$ is generated by a memory or calculation circuit 39 which receives the calculation time pulse $t_x$ as the time element and reads out or calculates in response to this pulse the value of $P(t)$.

Accordingly, during one calculation interval (period) the value of $P(t)$ does not vary, but the value of $P(t)$ varies each time pulse $tx$ is applied or each time a certain number of pulses $t_x$ are applied. The function $M(n)$ regarding the order of the harmonic is generated by a function generating circuit 40 corresponding to the order of each harmonic. The circuit 40 may comprise a suitable memory, calculating circuit, encoder or decoder so as to sequentially read out the values of functions M(2), M(3) . . . M(16) corresponding to the orders $n$ of respective harmonics in accordance with the calculation timing pulses $t_{c2}$ - $t_{c16}$ for the second to 16th harmonics.

When a pulse $t_{c2}$ is applied to the function generating circuit 40 during a certain calculating time interval $t_x$, the value of function M(2) of the second harmonic is read out so that the result of multiplication by the multiplier 34 will be $K \cdot P(t) \cdot M(2) = H_2$. This information $H_2$ is applied to the adder 28 via the gate circuit 35 and line 26. A former adder output $H_1 = \theta(t)$ stored in register 29 is also applied to the adder 28 via the gate circuit 30 so that the adder performs the addition of $H_1 + H_2 = \theta(t) + K \cdot P(t) \cdot M(2)$. The result of this addition is stored in the register 29 and applied to the circuit 31 as an input $X_2$. When next pulse $t_{c3}$ is received, the function value M(3) is read out of the circuit 40 and the multiplier 34 produces an output $K \cdot P(t) \cdot M(3) = H_3$. This output is added by the adder 28 to the former adder output $H_1 + H_2$ which has been stored in the register 29 aso as to perform an addition of $H_1 + H_2 + H_3 = \theta(t) + K \cdot P(t) \cdot [M(2) + M(3)]$. This result of addition is stored in the register 29 and applied to the circuit 31 as an input $X_3$. Thereafter, when the pulses $t_{c4}$ - $t_{c16}$ are respectively produced, function values M(4) - M(16) are produced and the outputs $H_4$ - $H_{16}$ from the multiplier 34 are cumulatively added in the accumulator 27. Consequently, the value $Xi$ of the output $X_n$ of the accumulator 27 regarding the $i$-th harmonic is expressed by a general equation $$Xi = \sum_{n=1}^{i} H_n = \theta(t) = K \cdot P(t) \cdot \sum_{n=2}^{i} M(n) \tag{3}$$

When a next pulse $t_x$ is generated to begin another calculation time interval $t_x$, the value of function $P(t)$ or $\theta(t)$ varies so that the value of $Xi(X_n)$ represented by equation (3) varies correspondingly.

The setting of the fundamental filter characteristic will be described hereunder with reference to a practical example. Assuming that $\theta(t) = 0$, $P(t) = 1$ = constant and that $M(n) = 1$ = constant, the position of each harmonic in the multipeak filter characteristic will be set in accordance with the value of K. When $K = 40$, the value of Xn corresponding to each harmonic order $n$ is shown in line A in the following Table 1 which value can be given by equation (3). In other words, since the accumulator 27 is of modulo 64, the surplus derived from dividing by 64 the value of $Xn$ calculated by equation (3) is the actual $Xn$ applied to the circuit 31

Table 1

| timing pulse | | $t_{c1}$ | $t_{c2}$ | $t_{c3}$ | $t_{c4}$ | $t_{c5}$ | $t_{c6}$ | $t_{c7}$ | $t_{c8}$ |
|---|---|---|---|---|---|---|---|---|---|
| order n(i) | | 1 | 2 | 3 | 4 | 5 | 6 | 7 | 8 |
| actual address $X_n$ | A | 0 | 40 | 16 | 56 | 32 | 8 | 48 | 24 |
| | B | 0 | 30 | 60 | 26 | 56 | 24 | 54 | 20 |
| | C | 0 | 40 | 24 | 16 | 16 | 28 | 44 | 4 |

Figure 4:
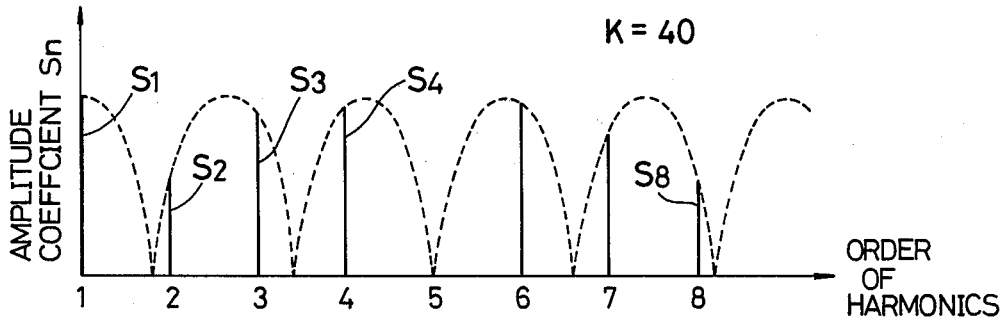
FIGS. 4*a*, 4*b* and 4*c* are graphs for explaining the change in the multipeak filter characteristic.
Figure 4:
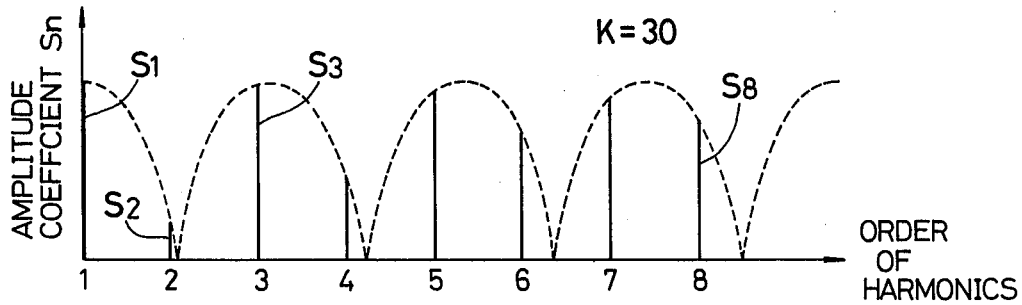
Figure 4:
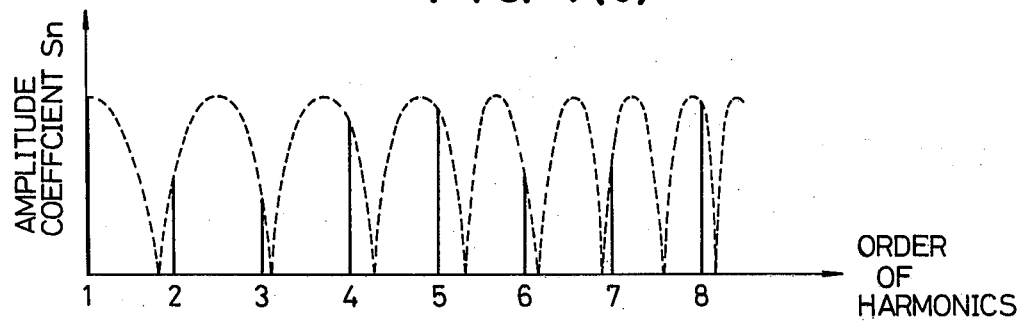

As a consequence, an amplitude coefficient $S_n$ as shown in FIG. 4a is read out of the basic equation executing circuit (memory) 31 having contents as shown in FIG. 3b in accordance with the address $X_n$. In the filter characteristic shown in FIG. 4a, the spacings between respective harmonics correspond to the value of constant K. Where constant $K = 30$, the value of $X_n$ is shown in line B of Table 1 so that the pass-band range or width of each single peak of the fundamental filter characteristic is broadened as shown in FIG. 4b. As a consequence, the range or width of the single peak of the multipeak filter characteristic is set according to the value of the constant K thus setting static fundamental filter characteristic.

The function $M(n)$ statically changes (i.e. selectively sets) the fundamental filter characteristic with reference to the frequency region. When the value of function $M(n)$ is always constant irrespective of the value of $n$, the spacing between respective harmonics of the fundamental filter characteristic is constant as shown in FIGS. 4a and 4b, whereas when the value of function $M(n)$ varies with $n$, the positions of respective harmonics in the fundamental filter characteristic will be modified or shifted. More particularly, since the positional relationship of respective of the tone harmonics is actually constant, then it should be understood as the fundamental filter characteristic is changed. Assuming now that $\theta(t) = 0$, $P(t) = 1$ = constant, $K = 40$, and that the value of function M(n) increases to $M(2) = 1$, $M(3) = 1.2$, $M(4) = 1.4$, $M(5) = 1.6$ and so on according to the values of the order $n = 2, 3, 4, 5 \ldots$ the value of $X_n$ will be shown by line C in Table 1. The graph shown in FIG. 4c shows these values. Thus, when the value of the function $M(n)$ increases with the order $n$, a multipeak filter characteristic will be obtained in which the width of the single peak decreases gradually as the frequency increases. Conversely, in a case where the value of the function M($n$) decreases with the increase in the order $n$, multipeak filter characteristic will be obtained in which the width of the respective single peak varies inversely with the frequency.

A dynamic variation with time of the filter characteristic will now be described. Where the time function P($t$) is given by a constant as above described, the multipeak filter characteristic which has been set in accordance with the constant K and/or the function M($n$) of the orders of the harmonics will maintain its characteristic irrespective of lapse of time. However, when the value of the function P($t$) varies with time, the filter characteristic also varies accordingly. Let us denote that the value of the function P($t$) during a certain calculation time interval $t_x$ by P($t_1$) and the value of the function P($t$) during another calculation time interval $t_x$ by P($t_2$). Then, when the value of P($t$) is large, as can be readily noted from equation (3), the speed of increase of the value $X_n$ regarding respective harmonics increases during the cumulative addition performed by the accumulator 27. Consequently, the width of the single peak of the resulting filter characteristic decreases. With reference to FIGS. 4*a* and 4*b* for convenience, when P($t_1$) > P($t_2$), the width of the single peak of the filter characteristic at time $t_1$(at the function value P($t_1$)) will be decreased as shown in FIG. 4*a*, whereas the width of the single peak at time $t_2$(at the function value P($t_2$)) increase as shown in FIG. 4*b*. Thus, the width of the single peak varies with time with the variation of the function P($t$), that is, the multipeak filter characteristic varies as a whole with time.

Of course, as shown in FIGS. 3*c* and 3*d*, as the frequency origin of the filter varies with the variation of function $\theta(t)$, the multipeak filter characteristic shown in FIGS. 4*a*, 4*b* and 4*c* shifts as a whole.

As above described, the second harmonic amplitude coefficients Sn($S_1$, $S_2$, . . . $S_{16}$) which provide a desired spectrum construction corresponding to a multipeak filter characteristic whose variation in the time region and the characteristic of the frequency region have been set by the constant K, functions P($t$), M($n$) and $\theta(t)$, are sequentially produced, harmonic by harmonic, by the filter 11 at the timing of the timing pulses $t_{c1}$ - $t_{c16}$.

In the harmonic amplitude multiplier 23, the waveform signal (sample values) of each harmonic is multiplied by a corresponding amplitude coefficient $S_n$ for imparting to each harmonic an amplitude factor corresponding to the spectrum construction of the multipeak filter characteristic. In this manner, the amplitude control is effected for each harmonic by the digital multipeak filter 11. If necessary, the first amplitude coefficient $C_n$ is also multiplied by the multiplier 23 so as to supply the result of multiplication $S_n \cdot C_n \cdot \sin \pi/W\ nqR = F^{(n)}$ to the accumulator 41. The accumulator 41 cumulatively adds the signals $F^{(n)}$ for respective harmonics at each calculation interval $t_x$ to obtain a musical tone waveform amplitude value $$X_o(qR) = \sum_{n=1}^{W} F^{(n)}$$

at one sampling point (reading address). This waveform amplitude value $X_o(qR)$ is applied to a digital-analogue converter 43 through a gate circuit 42 at a timing of the pulse $t_x$. The resulting analogue signal is converted to a musical tone through an audio system 44.

Figure 5A:
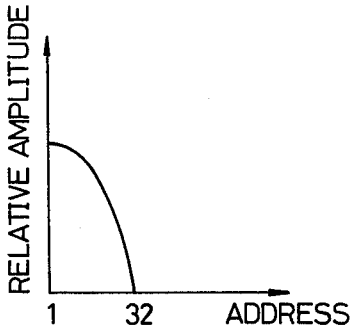
FIGS. 5*a* and 5*b*, and FIGS. 6*a* and 6*b* show other examples of the circuit for executing the basic equation.
Figure 5B:
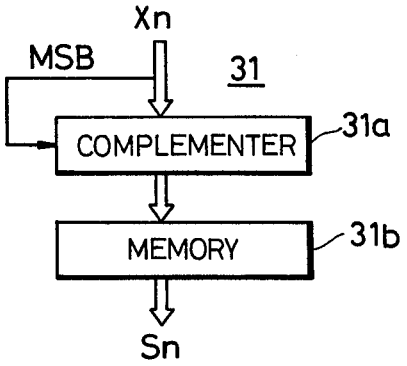

While in the foregoing embodiment a single peak filter characteristic as shown in FIG. 3*b* was stored in the memory circuit of the circuit 31 of the filter 11, it is also possible to store one half filter characteristic of the single peak as shown in FIG. 5*a*. In this case, as shown in FIG. 5(*b*), the data of the most significant bit MSB of the input $X_n$ to the circuit 31 is used to control a complementer 31*a* and the data of $X_n$ other than the most significant bit MSB are applied to a memory device 31*b* via the complementer 31*a* to act as the address signals. Thus, the remaining one half of the single peak not stored in the memory device 31*b* can be produced by reading in the opposite direction the address of the memory device 31*b* by the operation of the complementer.

Figure 6A:
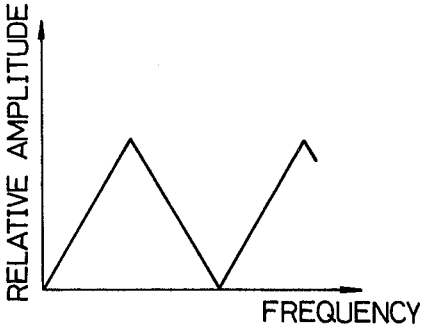
Figure 6B:
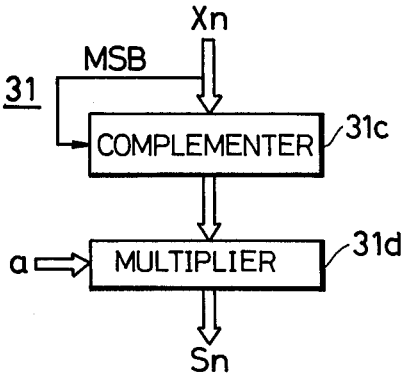

The form of the single peak of the filter characteristic prepared by the basic equation executing circuit 31 is not limited to the form shown in FIG. 3*a* but may be of any other form. For example, a single peak of the triangular shape shown in FIG. 6*a* can readily be obtained by operating a linear function by the circuit 31. More particularly, the data other than the most significant bit MSB of the information $X_n$ from the accumulator 27 is applied to a complementer 31*c* and is multiplied with a gradient $a$ in a multiplier 31*a* to produce a single peak of triangular form. Of course, it is possible to use the output from the complementer 31*c* as the amplitude coefficient. If a saw-tooth waveform is used as the single peak form, the output $X_n$ from the accumulator 27 can be used as the amplitude coefficient $S_n$ without any processing.

What is claimed is:

1. In an electronic musical instrument of the type having calculating circuitry for individually calculating the amplitude of each harmonic component, said circuitry providing a signal indicative of the order of the harmonic component currently being calculated, an accumulator for accumulating the amplitudes of all harmonic components to establish a sample point amplitude for the tone being generated, and a converter for converting the established sample point amplitudes to musical tones, the improvement for imparting a multipeak filter characteristic to said musical tones, comprising:

a first circuit, operative when said signal indicates that the harmonic component of lowest order is being calculated, for providing a value $H_1$ establishing the initial point of said multipeak filter characteristic, a second circuit, for establishing separate values $H_n$ for values of $n$ greater than 1, where $n$ is the harmonic component order, an accumulation circuit for accumulating the sum of $H_1$ plus all of the separate values $H_n$ for each harmonic component or order lower than that of the harmonic component currently being evaluated to obtain an accumulated value $$Xn = H_1 + \sum_{n=2}^{i-1} H_n$$

where $i$ is the current harmonic component order, multipeak filter means connected to receive the output of said accumulation circuit, for providing a multipeak filter relative amplitude value in accordance with the accumulated value $X_n$ received from said accumulation circuit.

2. The electronic musical instrument according to claim 1 wherein said multipeak filter means comprises a memory storing sampled values S of one cycle of the multipeak filter characteristic in M storage locations, wherein said accumulation circuit is of modulo M, and wherein said multipeak filter means accesses from said memory the value $S_n$ corresponding to a memory location established by the accumulated value $X_n$ received from said accumulation circuit.

3. The electronic musical instrument according to claim 2 wherein said first circuit produces values of $H_1$ which vary with the lapse of time, thereby causing the initially accessed single peak filter characteristic value $S_1$ to vary with time.

4. The electronic musical instrument according to claim 2 wherein said second circuit establishes each value $H_n$ by a multiplier circuit which multiplied together three values $M_{(n)}$, $P(t)$ and K, each of which may be a constant, so that $H_n = M_{(n)} \cdot P(t) \cdot K$ where $K$ is a selectable value which establishes the width of each peak in said multipeak characteristic, where $M_{(n)}$ is a value, associated with each harmonic order $n$ greater than 1, that establishes the difference in width of each peak as a function of harmonic order, and $P(t)$ is a time variant value that changes the width of each peak with the lapse of time.

5. In a musical instrument of the type wherein the amplitudes of respective harmonic components which constitute a musical tone are set independently by amplitude coefficients corresponding to the respective harmonics, said instrument including calculating circuitry for individually calculating the amplitude of each harmonic component, said circuitry providing a signal indicative of the order $n$ of the harmonic component currently being calculated, an accumulator for accumulating the amplitudes of all harmonic components, and converter means for converting the accumulated amplitudes to musical tones, the improvement for providing amplitude coefficients of the respective harmonics that are imparted with a multipeak filter characteristic, comprising:

a multipeak filter memory means (31) for storing in A consecutive memory locations a single peak of a multipeak filter characteristic of relative amplitude coefficient values $S_n$ as a function of a frequency variable $X_n$, and frequency variable means, connected to receive from said calculating circuitry said order indicative signal $n$, for providing to said multipeak filter memory means a specific value of said frequency variable $X_n$ that is established by said current harmonic component order $n$ independent of the absolute frequency of said component, said multipeak filter memory means receiving said frequency variable specific value $X_n$ and providing to said calculating circuitry the corresponding amplitude coefficient $S_n$, said calculating circuitry scaling said currently calculated harmonic component amplitude in accordance with said provided amplitude coefficient, said frequency variable means including:

first circuit means (32, 33), operative when said received signal is indicative of order $n=1$, for establishing the initial frequency variable $X_1 = H_1$ provided to said multipeak filter memory means, second circuit means (34-40), operative when the received signal is indicative of order $n=2$ or greater, for establishing corresponding harmonic information values $H_n$, and an accumulator of modulo A (27) for summing all of said harmonic information values $H_n$ for orders lower than said currently calculated harmonic component order, said accumulator resetting to zero and continuing said summation therefrom each time that the sum in said accumulator exceeds A, the sum produced by said accumulator being said frequency variable $X_n$.

6. The electronic musical instrument according to claim 5 wherein the harmonic information value for each harmonic component of order greater than one is established by multiplying a selectable constant which establishes the width of each peak in said multipeak characteristic by a number determined by the harmonic component order, said number thereby modifying the width of each peak in said multipeak characteristic as a function of harmonic order, said multiplication being accomplished by a multiplier circuit the output of which is supplied to said accumulator.

* * * * *